US011545284B2

(12) United States Patent
Higashi et al.

(10) Patent No.: US 11,545,284 B2
(45) Date of Patent: Jan. 3, 2023

(54) VARISTOR ASSEMBLY

(71) Applicant: Panasonic Intellectual Property Management Co., Ltd., Osaka (JP)

(72) Inventors: Yoshiko Higashi, Osaka (JP); Eiichi Koga, Osaka (JP); Masayuki Takagishi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/299,774

(22) PCT Filed: Dec. 2, 2019

(86) PCT No.: PCT/JP2019/047077
§ 371 (c)(1),
(2) Date: Jun. 3, 2021

(87) PCT Pub. No.: WO2020/149034
PCT Pub. Date: Jul. 23, 2020

(65) Prior Publication Data

US 2022/0020512 A1 Jan. 20, 2022

(30) Foreign Application Priority Data

Jan. 16, 2019 (JP) ..... JP2019-004888

(51) Int. Cl.
*H01C 7/10* (2006.01)
*H01C 1/14* (2006.01)
*H01C 17/28* (2006.01)

(52) U.S. Cl.
CPC ..... *H01C 7/1006* (2013.01); *H01C 1/14* (2013.01); *H01C 17/28* (2013.01)

(58) Field of Classification Search
CPC ..... H01C 7/1006; H01C 1/14; H01C 17/28
See application file for complete search history.

(56) References Cited

U.S. PATENT DOCUMENTS 4,290,041 A * 9/1981 Utsumi ..... H01C 7/102 338/21
4,675,644 A * 6/1987 Ott ..... H01C 17/06546 338/21

(Continued)

FOREIGN PATENT DOCUMENTS

CN 101286394 A 10/2008
JP 50-149845 U 12/1975

(Continued)

OTHER PUBLICATIONS

International Search Report of PCT application No. PCT/JP2019/047077 dated Feb. 10, 2020.

(Continued)

*Primary Examiner* — Kyung S Lee
(74) *Attorney, Agent, or Firm* — McDermott Will & Emery LLP

(57) ABSTRACT

Provided is a varistor assembly capable of achieving good surge breakdown voltage while suppressing capacitance. The varistor assembly is obtained by connecting a plurality of varistor elements in parallel. Each varistor element includes: a sintered body obtained by sintering a laminate in which varistor layers and internal electrodes are alternately laminated; and a pair of external electrodes provided in a state where the internal electrodes are alternately connected on at least both end faces of this sintered body. Varistor element includes at least a plurality of first group varistor elements in which a value obtained by dividing a surface area of the sintered body by a volume of the sintered body is 1.9 $mm^{-1}$ or more.

6 Claims, 5 Drawing Sheets

(56) References Cited

U.S. PATENT DOCUMENTS

| | | | | | |
|---|---|---|---|---|---|
| 5,075,665 | A * | 12/1991 | Taira | H01C 1/14 | 338/273 |
| 5,130,884 | A * | 7/1992 | Allina | H01C 7/12 | 338/21 |
| 5,519,564 | A * | 5/1996 | Carpenter, Jr. | H01C 7/12 | 338/21 |
| 7,683,753 | B2 * | 3/2010 | Yoshida | H01C 7/112 | 338/21 |
| 7,994,893 | B2 * | 8/2011 | Matsuoka | C04B 35/453 | 338/21 |
| 2006/0061449 | A1 | 3/2006 | Kazama | | |
| 2008/0238605 | A1 | 10/2008 | Yoshida et al. | | |
| 2010/0136337 | A1 | 6/2010 | Ando et al. | | |
| 2014/0085043 | A1 * | 3/2014 | Suzuki | H01C 7/12 | 338/21 |
| 2019/0304636 | A1 * | 10/2019 | Kirk | H02H 9/02 | |

FOREIGN PATENT DOCUMENTS

| | | |
|---|---|---|
| JP | 55-014727 U | 1/1980 |
| JP | 6-333773 | 12/1994 |
| JP | 2006-086274 | 3/2006 |
| JP | 2008-218749 | 9/2008 |
| JP | 2008-273818 | 11/2008 |

OTHER PUBLICATIONS

English Translation of Chinese Office Action dated Jul. 19, 2022 for the related Chinese Patent Application No. 201980088130.6.

* cited by examiner

VARISTOR ASSEMBLY

FIELD OF THE INVENTION

The present disclosure relates to a varistor assembly that protects a semiconductor element or the like from a surge or static electricity.

Description of the Related Art

When abnormal voltage such as a surge or static electricity is applied to an element constituting a circuit of an electronic device, for example, a semiconductor integrated circuit (IC), the electronic device may malfunction or be destroyed. A varistor is an example of an electronic component that protects an electronic device from such abnormal voltage. PTL 1 and PTL 2 are examples of conventional varistor-related technique.

CITATION LIST

Patent Literature

PTL 1: Unexamined Japanese Patent Publication No. 2008-218749

PTL 2: Unexamined Japanese Patent Publication No. 2006-86274

SUMMARY OF THE INVENTION

A zinc oxide varistor is a ceramic polycrystal obtained by adding additives such as a bismuth element and a praseodymium element to zinc oxide and sintering it. For the purpose of protection from a surge with a large amount of energy, measures such as enlargement of an element and expansion of an area of an internal electrode have been taken. However, capacitance has become too large, and sufficient surge breakdown voltage has not been obtainable. A varistor having good surge breakdown voltage in a large current region, which cannot be achieved by a conventional varistor, is desired.

In order to solve the above problems, a varistor assembly of the present disclosure includes a plurality of varistor elements connected in parallel, and has the following configuration. In other words, each of the plurality of varistor elements includes a sintered body and a pair of external electrodes. The sintered body is obtained by sintering a laminate having a plurality of varistor layers and a plurality of internal electrodes and in which the varistor layers and the internal electrodes are alternately laminated. The sintered body has a pair of end faces located in a direction along surfaces where the varistor layers and the internal electrodes are in contact with each other. The pair of external electrodes is provided on the pair of end faces. The plurality of varistor elements includes a plurality of first group varistor elements. Each of the first group varistor elements has $S/V \geq 1.9\ mm^{-1}$ or more, where S is a surface area of the sintered body and V is a volume of the sintered body.

With the above configuration, good surge breakdown voltage can be achieved while suppressing capacitance.

DETAILED DESCRIPTION OF THE PREFERRED EMBODIMENTS

Figure 1:
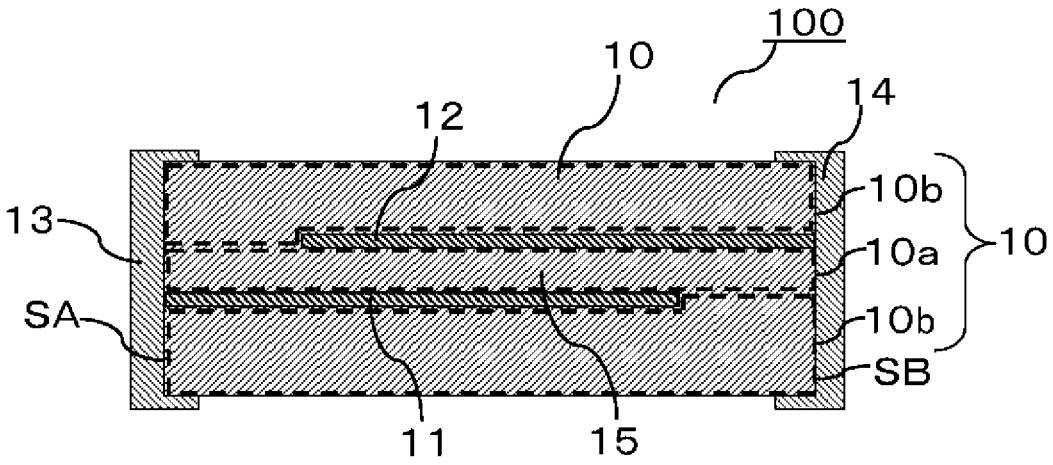
FIG. 1 is a sectional view of a varistor element in an exemplary embodiment of the present disclosure.

The following exemplary embodiments each illustrate a specific example. Numerical values, shapes, materials, components, arrangement positions and connection configurations of the components, and the like shown in the following exemplary embodiments are mere examples, and are not intended to limit an invention according to the present disclosure. Among the components in the exemplary embodiments described below, components which are not described in the independent claims showing the top level concept are described as arbitrary components. Note that, in the following, the same or corresponding elements will be designated by the same reference numerals throughout all the drawings, and duplicate description thereof will be omitted.

Example 1

A varistor of the present disclosure improves withstand characteristic by a configuration in which a plurality of elements is connected. In other words, by adopting the connection configuration, it is possible to maintain withstand characteristic even if capacitance (an electrode area) is smaller than before.

The varistor of the present disclosure is used for a high-energy surge such as an in-vehicle application. For the high-energy surge countermeasures, for example, a large laminated varistor with a length (L) of 5.7 mm, a width (W) of 5.0 mm, and a height (T) of 3.0 mm (5.7×5.0×3.0 mm) as a size is often used. The problem is that withstand characteristic is insufficient. For example, in an application such as protection of an engine electronic control unit (ECU) from a load dump surge that occurs when a battery line is broken, withstand characteristics when direct current (DC) voltage is applied is required in addition to improving a protection effect (lowering clamping voltage when an ISO standard waveform is applied). To improve the protection effect, reduction of varistor voltage ($V_{1\ mA}$, voltage when 1 mA is applied) is a general measure. However, since current when the load dump surge is applied increases, a load on the element increases. Also, when the DC voltage is applied, an amount of current increases. In this way, the improvement of the protection effect and the load dump surge/DC withstand characteristics are in a trade-off relationship, and there is a problem in achieving both. Until now, the withstand characteristic has been improved by increasing size of an element, increasing a number of layers and an area of opposing electrodes, and lowering current density, but an expected effect has not been obtainable. A possible cause for this is a decrease in heat dissipation due to the increase in size of the element. Therefore, as a method of maintaining high heat dissipation and increasing the electrode area, a configuration in which small elements are connected is used. Note that, hereinafter, a size of L mm in length, W mm in width, and T mm in height are referred to as L×W×T mm size or simply L×W×T.

FIG. 1 is a sectional view of a laminated varistor in an exemplary embodiment.

Varistor element 100 includes varistor layer 10*a*, internal electrode 11 (first electrode) that is in contact with varistor layer 10*a*, and internal electrode 12 (second electrode) that is in contact with varistor layer 10*a* and faces internal electrode 11 via varistor layer 10*a*. Further, invalid layer 10*b* made of the same material as varistor layer 10*a* is disposed in contact with internal electrode 11 and internal electrode 12. Varistor layer 10*a* and invalid layer 10*b* are integrally formed to form element body 10. Internal electrode 11 is embedded in element body 10, and one end thereof is exposed to one end face SA of element body 10 and is electrically connected to external electrode 13 on one end face SA. Internal electrode 12 faces internal electrode 11 and is embedded in element body 10. One end of internal electrode 12 is exposed to another end face SB on a side opposite to one end face SA of element body 10, and is electrically connected to external electrode 14 on other end face SB.

Note that the varistor of the present disclosure will be described by taking the laminated varistor as an example of the exemplary embodiment. However, the present disclosure is not limited to this, and can be applied to various varistors used for protecting electronic devices from abnormal voltage.

Figure 2:
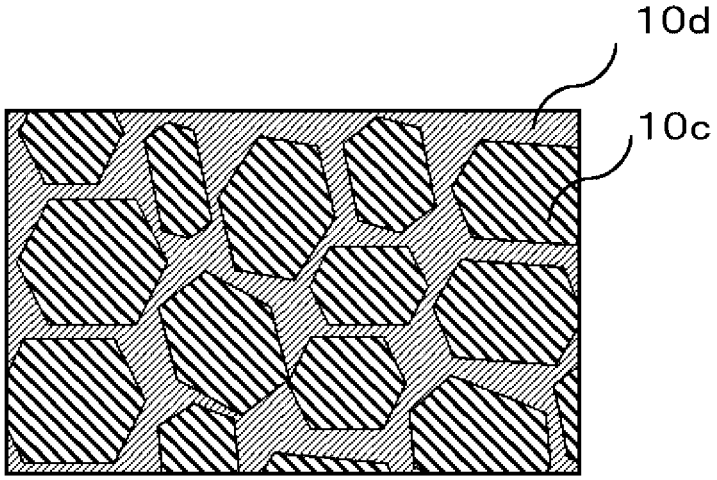
FIG. 2 is an enlarged sectional view of a part of a voltage non-linear resistor composition in the varistor element of FIG. 1.

FIG. 2 is an enlarged sectional view of a part of element body 10 in varistor element 100 of FIG. 1. Element body 10 is composed of a plurality of zinc oxide particles 10*c* as a main component and oxide layer 10*d* containing a bismuth element, a cobalt element, a manganese element, an antimony element, a nickel element, and a germanium element. Each of the plurality of zinc oxide particles 10*c* has a crystal structure composed of a hexagonal system. Oxide layer 10*d* is interposed between the plurality of zinc oxide particles 10*c*.

Element body 10 is a voltage non-linear resistor composition composed of the plurality of zinc oxide particles 10*c* and oxide layer 10*d* interposed between the plurality of zinc oxide particles 10*c*.

Voltage non-linearity of the varistor will be described. A resistance value of the varistor sharply decreases after a certain applied voltage value. This causes the varistor to have a non-linear characteristic between voltage and current. In other words, it is preferable to have a varistor showing a higher resistance value in a region where applied voltage has a low voltage value and a lower resistance value in a region where the applied voltage has a high voltage value. In the present disclosure, this non-linearity is defined as a voltage value $V_{1\ mA}$ (varistor voltage) when a current of 1 mA is applied to the voltage non-linear resistor composition.

Next, a method of manufacturing varistor element 100 will be described.

Figure 3:
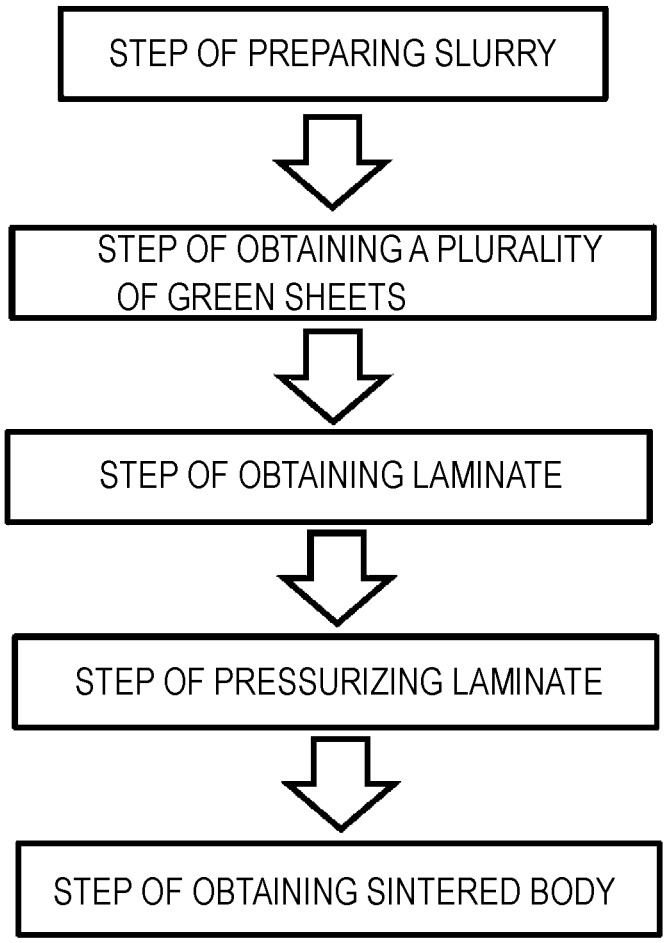
FIG. 3 is a flowchart showing a method of manufacturing the varistor element in the exemplary embodiment of the present disclosure.

FIG. 3 is a manufacturing flowchart showing a manufacturing process of varistor element 100.

First, a zinc oxide powder, a bismuth oxide powder, a cobalt oxide powder, a manganese oxide powder, an antimony oxide powder, a nickel oxide powder, and a germanium oxide powder are prepared as starting materials for element body 10. Here, the zinc oxide powder has a flat shape.

A compounding ratio of the starting materials is 96.54 mol % for the zinc oxide powder, 1.00 mol % for the bismuth oxide powder, 1.06 mol % for the cobalt oxide powder, 0.30 mol % for the manganese oxide powder, 0.50 mol % for the antimony oxide powder, 0.50 mol % for the nickel oxide powder, and 0.10 mol % for the germanium oxide powder. Slurry containing these powders and an organic binder is prepared. Note that, here, mol % means a mole percentage.

Next, a step of obtaining a plurality of green sheets will be described in detail.

Figure 4:
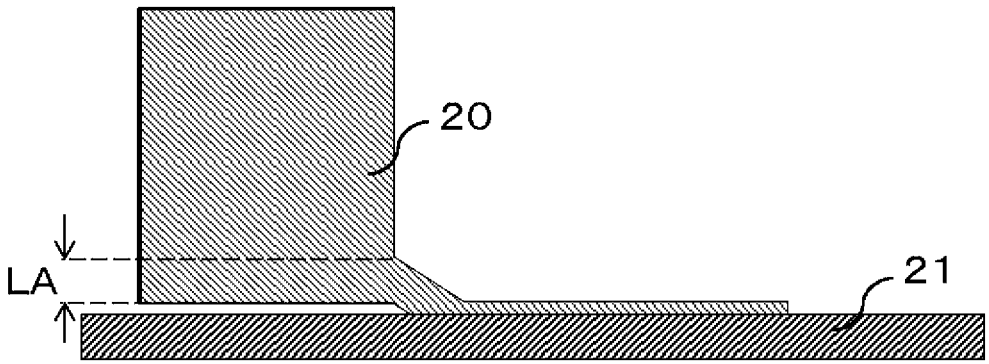
FIG. 4 is a sectional view of an apparatus in a step of obtaining a plurality of green sheets according to the exemplary embodiment.

FIG. 4 is a sectional view of an apparatus schematically showing the step of obtaining the plurality of green sheets.

The plurality of green sheets is obtained by applying above-mentioned slurry 20 onto film 21 made of polyethylene terephthalate (PET) through a gap of 180 μm as width LA and drying it.

Next, electrode paste containing an alloy powder of silver and palladium is printed on a predetermined number of the plurality of green sheets in a predetermined shape, and the predetermined number of these plurality of green sheets is laminated to obtain a laminate.

Next, this laminate is pressurized at 55 MPa in a direction perpendicular to a surface direction of the plurality of green sheets. This pressing force preferably ranges from 30 MPa to 100 MPa inclusive. By pressurizing the laminate at a pressure of 30 MPa or more, adhesion between the green sheets is enhanced, and an element without a structural defect can be obtained. By pressurizing the laminate at less than or equal to 100 MPa, the shape of the electrode paste inside the laminate can be maintained. Then, the obtained laminate is cut into each element size to produce a laminate chip.

Next, this laminate chip is sintered at 850° C. to obtain a sintered body including element body 10 (voltage non-linear resistor composition), internal electrode 11, and internal electrode 12. By this sintering, the plurality of zinc oxide powders as the starting materials become the plurality of zinc oxide particles 10*c* shown in FIG. 2, and a voltage non-linear resistor in which oxide layer 10*d* is interposed between the plurality of zinc oxide particles 10*c* can be obtained.

Next, the electrode paste containing the alloy powder of silver and palladium is applied to one end face SA and other end face SB of element body 10 and heat-treated at 800° C. to form external electrode 13 and external electrode 14. Note that external electrode 13 and external electrode 14 may be formed by a plating method. Further, as external electrode 13 and external electrode 14, an external electrode formed by sintering the electrode paste and an external electrode formed by the plating method may be combined.

In order to examine only an influence of the element size, materials of the same composition were used, thickness of element body 10 was designed such that $V_{1\ mA}$ of the element is 22 V (±2 V), and sintering conditions were determined such that material constants after sintering are the same.

A varistor assembly of the present disclosure will be described in detail.

Varistor element 100 obtained by the above-mentioned manufacturing method was used as Example 1, a conventional laminated varistor for load dump surge countermeasures was used as Comparative Example 1, and each withstand characteristic was evaluated. In order to perform evaluation with the same current density, a quantity that can obtain the same capacitance as Comparative Example 1 was obtained from capacitance of the elements of each size such that electrode areas are the same. Withstand characteristic of the varistor elements connected in parallel was evaluated and compared. Tables 1 and 2 show element sizes and connection configurations of Example 1 (element Nos. 1 to 6) and Comparative Example 1 (element Nos. 1, 2). Table 1 is a table showing specifications and the connection configuration of varistor elements used for connected elements in Example 1. Table 2 is a table showing a relationship between capacitance, load dump surge breakdown voltage, and withstand current at the time of connecting the varistor elements used for the connected elements in Example 1. In each element, S is the sum of surface areas of six surfaces thereof, and V is a volume. Both S and V do not include external electrodes. SN expresses a ratio between volume and an element surface area for each element size. Surge breakdown voltage was evaluated by measuring clamping voltage and withstand current using a load dump surge waveform specified by ISO7637-2. The withstand current (current at which thermal runaway starts) was also measured for withstand characteristic of DC voltage.

TABLE 1

| | Element No. | L (mm) | W (mm) | T (mm) | S ($mm^3$) | V ($mm^3$) | S/V ($mm^{-1}$) |
|---|---|---|---|---|---|---|---|
| Example 1 | 1 | 1.6 | 0.8 | 0.8 | 6.4 | 1.0 | 6.3 |
| | 2 | 2.0 | 1.2 | 1.2 | 12.5 | 2.9 | 4.3 |
| | 3 | 3.2 | 1.6 | 1.6 | 25.6 | 8.2 | 3.1 |
| | 4 | 3.2 | 2.5 | 1.6 | 34.2 | 12.8 | 2.7 |
| | 5 | 4.5 | 3.2 | 2.3 | 64.2 | 33.1 | 1.9 |
| | 6 | 5.7 | 5.0 | 1.8 | 95.5 | 51.3 | 1.9 |
| Comparative | 1 | 5.7 | 5.0 | 3.0 | 121.2 | 85.5 | 1.4 |
| Example 1 | 2 | 5.7 | 5.0 | 2.0 | 99.8 | 57.0 | 1.8 |

TABLE 2

| | Element No. | Capacitance (pF) (per one element) | Number of pieces connected during test (piece) | Capacitance (pF) (during connection) | Load dump surge withstand voltage (V) | Withstand current (A) |
|---|---|---|---|---|---|---|
| Example 1 | 1 | 180 | 200 | 36000 | 100 or more | 10.8 |
| | 2 | 350 | 100 | 35000 | 100 or more | 7.3 |
| | 3 | 1200 | 30 | 36000 | 100 or more | 6.9 |
| | 4 | 1800 | 20 | 36000 | 100 or more | 6.5 |
| | 5 | 7000 | 5 | 35000 | 90 | 0.72 |
| | 6 | 18000 | 2 | 36000 | 85 | 0.65 |
| Comparative | 1 | 37000 | 1 | 37000 | 70 | 0.1 |
| Example 1 | 2 | 20000 | 2 | 40000 | 75 | 0.18 |

Figure 5:
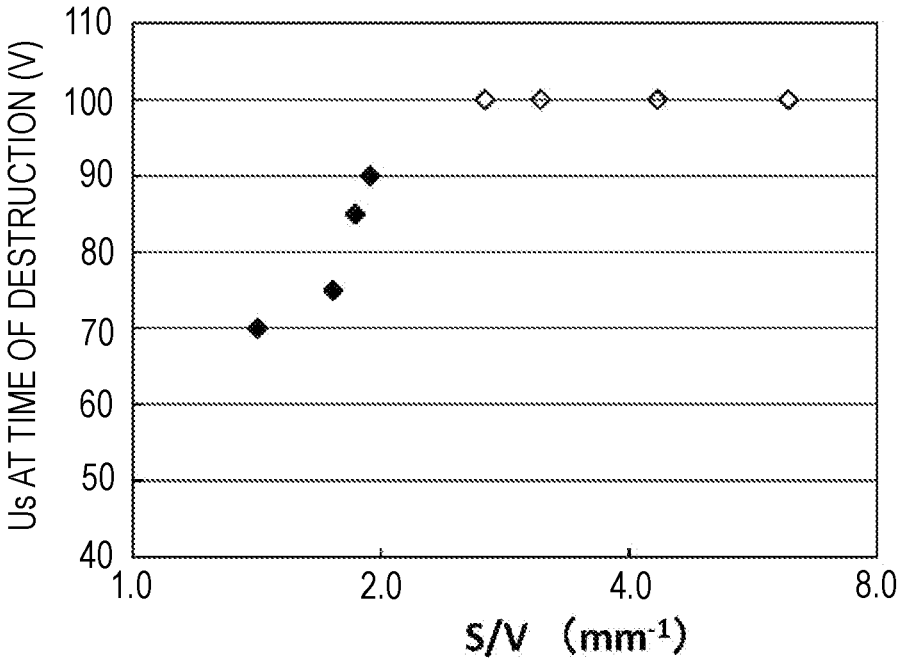
FIG. 5 is a graph showing a relationship between a surface area-volume ratio of the varistor element and top voltage of a waveform at the time of element destruction in a load dump surge test in Example 1 of the present disclosure.

FIG. 5 shows a relationship between the S/V and the load dump surge breakdown voltage. Us is top voltage of the surge waveform, and a voltage value at the time of destruction of each element was used. Evaluation of the load dump surge breakdown voltage was performed at DC=14 V, Ri=0.5 Ω, td=0.2 seconds (sec), and an interval of 1 minute (min) under the conditions specified by ISO7637-2. When the Us was applied ten times and the element was not destroyed, it was judged to be durable. As shown in Table 1, it can be seen that the S/V increases as the element becomes smaller. As is clear from FIG. 5, as the S/V increases, breakdown voltage increases, and withstand characteristic improves. When two or more elements with S/V≥1.9 are connected, even with a configuration in which the capacitance (electrode area) is smaller than that in Comparative Examples 1-1 and 1-2 at the time of connection, an effect of improving the load dump surge breakdown voltage can be obtained. Hereinafter, an element having an S/V≥1.9 $mm^{-1}$ is referred to as a first group varistor element. Note that element Nos. 1 to 4 have extremely strong withstand characteristic and were not destroyed even when Us=100V was applied ten times (shown in white in FIG. 5). With the same electrode area as that in Comparative Example 1, it is possible to improve the breakdown voltage by 40% or more. It is considered that this is because the ratio of the surface area to the ceramic element body is increased, which makes it easier to dissipate Joule heat when a surge is applied. As described above, by adopting the configuration having high heat dissipation, the surge breakdown voltage is significantly improved. Moreover, in practical use, if the element is not destroyed even when Us=87V is applied, a breakdown voltage equivalent to that of an 8 W Zener diode can be achieved. In other words, it can be seen that the breakdown voltage Us of the configuration of the varistor assembly in which five elements having 4.5×3.2×2.3 mm size are connected in parallel is 90 V, and the element is applicable to practical use. In addition, it has been confirmed that the withstand characteristic is improved by 28.5% with the same electrode area by connecting small elements. In other words, it is possible to obtain the same withstand characteristic even if the electrode area is reduced as compared with that of the current one. This is an effect that leads to a reduction in the capacitance of the element, and is a method that can be applied to a high-frequency circuit and the like. It can be seen that a connected structure can achieve withstand characteristic that is difficult with a single element. Note that a varistor assembly in which n elements of L×W×T mm size are connected in parallel is referred to as L×W×T mm size×n. Note that, hereinafter, parallel connection may be simply referred to as connection.

Further, from results of the present example, it is preferable that a number of elements connected be more than or equal to five (from a result of 4.5×3.2×2.3 mm size) considering the electrode area that can be formed on each element and the energy of the abnormal voltage (load dump surge) to be applied and less than or equal to 200 (from a result of 1.6×0.8×0.8 mm size) considering a practical mounting area.

Figure 6:
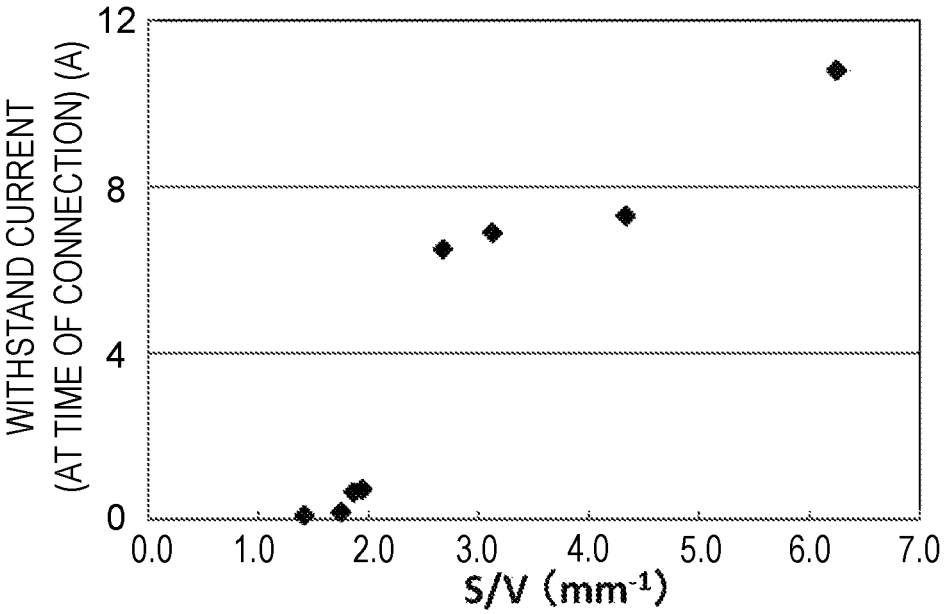
FIG. 6 is a graph showing a relationship between the surface area-volume ratio of the varistor element and current at the time of element destruction in a DC application test in Example 1 of the present disclosure.

Next, results of the withstand current of Comparative Example 1 and Example 1 (element Nos. 1 to 6, and elements connected so as to correspond to the capacitance of Comparative Example 1) in a DC voltage test shown in Tables 1 and 2 will be described. FIG. 6 shows an influence of the element surface area on the withstand current during the DC voltage test. It was confirmed that the DC withstand characteristic is improved by increasing the S/V as well as the load dump surge breakdown voltage. Destruction due to the DC voltage is also due to thermal damage, and it can be seen that a configuration with high heat dissipation is highly effective in improving the withstand characteristic. For example, the withstand current of Example 1-5 (4.5×3.2×2.3 mm size×5) is improved from 0.1 A to 0.72 A, and Example 1-6 (5.7×5.0×1.8 mm size×2) is improved from 0.1 A to 0.65 A with respect to Comparative Example 1-1 (5.7×5.0×3.0 mm size×1). As described above, the effect of improving the load dump surge breakdown voltage can be obtained by connecting two elements with S/V≥1.9 $mm^{-1}$. In order to further lower the clamping voltage, it is more preferable to connect five or more elements. In other words, assuming that n1 is the number of first group varistor elements connected, 2≤n1 is preferable, and 5≤n1 is more preferable. Note that an upper limit of the number of first group varistor elements connected is 200 in consideration of a practical mounting area. In other words, the number of first group varistor elements connected n1 is preferably n1≤200 in consideration of the practical mounting area.

Further, when an element having an S/V of 2.7 $mm^{-1}$ or more is used, both the load dump surge and the DC withstand characteristic are remarkably improved. It can be said that a configuration is such that an effect can be rapidly obtained in improving the withstand characteristic due to heat dissipation.

Example 2

By connecting a plurality of elements having different S/V values, withstand characteristic can be further improved. With this configuration, an electrode area can be reduced, and effects of reducing capacitance and miniaturization of connected elements can be obtained. Tables 3 and 4 show configurations of test elements, capacitance, electrode areas, and results of DC tests (withstand current and withstand current density) of the connected elements in Example 1, Example 2, and a comparative example. Table 3 shows specifications of varistor elements used for the connected elements, and the capacitance, the electrode area, the withstand current, the withstand current density, and load dump surge breakdown voltage at the time of connection in Examples 1 and 2. Table 4 shows specifications of the varistor elements used for the connected elements, and the capacitance, the electrode area, the withstand current, the withstand current density, and load dump surge breakdown voltage at the time of connection in the comparative example. In the comparative example, Comparative Example 1-1 shows a result of a single element of L×W×T=5.7×5.0×3.0, and Comparative Example 1-2 shows a result obtained by connecting two elements of L×W×T=5.7×5.0×2.0. On the other hand, in Example 1, Example 1-5 (an element related to No. 5 of Example 1, obtained by connecting five elements of L×W×T=4.5×3.2×2.3) was adopted. In Example 2, as Example 2-1, elements obtained by connecting four elements of L×W×T=4.5×3.2×2.3 and four elements of L×W×T=3.2×2.5×1.6 were adopted As Example 2-2, elements obtained by connecting eight elements of L×W×T=3.2×2.5×1.6 to one element of L×W×T=5.7×5.0×2.0 were adopted. As Example 2-3, elements obtained by connecting three elements of L×W×T=4.5×3.2×2.3 and four elements of L×W×T=3.2×2.5×1.6 were adopted. Results of the elements of these examples and the elements of the comparative example are described.

TABLE 3

| | Example 1-5 | Example 2-1 | Example 2-2 | Example 2-3 |
|---|---|---|---|---|
| Connected element configuration | 4.5 × 3.2 × 2.3 (mm) × 5 | 4.5 × 3.2 × 2.3 (mm) × 4<br>3.2 × 2.5 × 1.6 (mm) × 4 | 5.7 × 5.0 × 2.0 (mm) × 1<br>3.2 × 2.5 × 1.6 (mm) × 8 | 4.5 × 3.2 × 2.3 (mm) × 3<br>3.2 × 2.5 × 1.6 (mm) × 4 |
| C(nF) | 35.1 | 34.2 | 34.4 | 28.2 |
| Electrode area ($mm^2$) | 55.70 | 53.98 | 54.59 | 42.84 |
| Withstand current (A) | 0.72 | 1.06 | 0.40 | 0.69 |
| Withstand current density ($A/mm^2$) | 0.0129 | 0.0196 | 0.0073 | 0.0162 |
| Load dump surge voltage (V) | 90 | 95 | 80 | 90 |

TABLE 4

| | Comparative Example 1-1 | Comparative Example 1-2 |
|---|---|---|
| Connected element configuration | 5.7 × 5.0 × 3.0 (mm) × 1 | 5.7 × 5.0 × 2.0 (mm) × 2 |
| C(nF) | 37.0 | 40.4 |
| Electrode area ($mm^2$) | 58.72 | 64.11 |
| Withstand current (A) | 0.10 | 0.18 |
| Withstand current density ($A/mm^2$) | 0.0017 | 0.0028 |
| Load dump surge voltage (V) | 70 | 75 |

From the results of Examples 2-1 and 1-5, it can be seen that even if the capacitance is the same (however, less than or equal to the capacitance of Comparative Example 1-1), that is, the electrode area is the same, incorporation of the small element of S/V≥1.9 $mm^{-1}$ into the configuration improves the withstand current density by about 50%. Hereinafter, an element having an S/V<1.9 $mm^{-1}$ is referred to as a second group varistor element. In addition, from the results of Example 2-3, even if the number of elements is reduced and the capacitance is reduced by 18%, it was found out that the withstand current density and the load dump surge breakdown voltage are improved as compared with Comparative Examples 1-1 and 1-2. By combining the elements of different sizes, it is possible to improve the withstand characteristic and reduce the number of elements connected. It is considered that this is because an effect of improving heat dissipation of all the connected elements was obtained by incorporating a small element having good heat dissipation. In this way, the withstand characteristic of a large element is improved by connecting with the small element. However, for connection of large elements with 5.7×5.0×3.0 mm size and a capacitance of about 40 nF per one element, it is preferable that the number of elements connected be more than or equal to one and less than or equal to five in consideration of the capacitance at the time of connection. In other words, assuming that n2 is the number of second group varistor elements connected, it is preferable that $1 \leq n2 \leq 5$ is satisfied.

Figure 7:
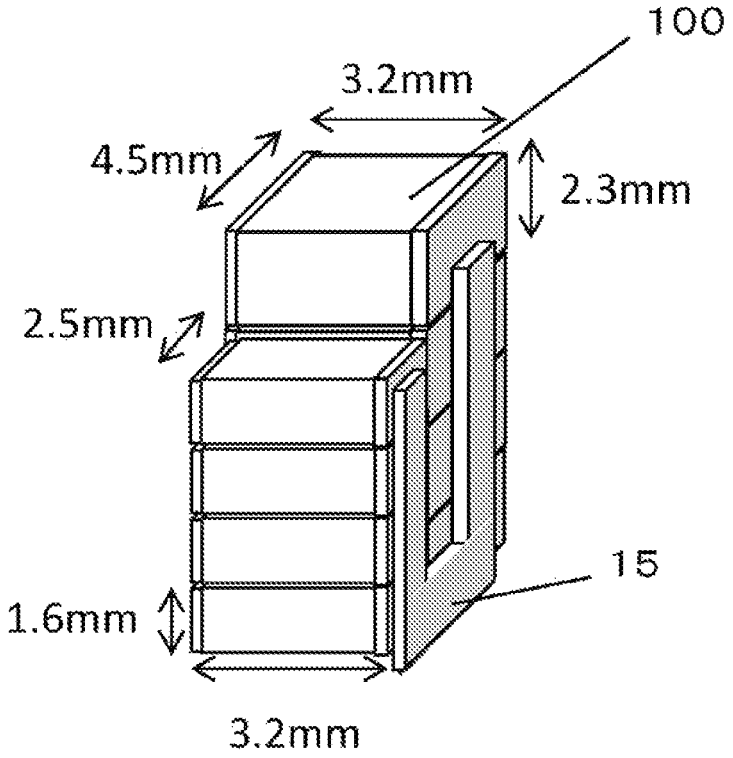
FIG. 7 is a perspective view which shows an example of a connection structure of four varistor elements of L×W×T=4.5×3.2×2.3 mm and four varistor elements of L×W×T=3.2×2.5×1.6 mm in Example 2 of the present disclosure.

Furthermore, since it is possible to mount elements in a stepped manner, even in a stack structure or a mounting form at a close contact position, heat dissipation is higher than that in a case of combining elements of the same size, and withstand characteristic can be improved. In addition to stacking the elements at the time of mounting, as shown in FIG. 7, an electrode forming surface may be formed such that an element of L×W×T=4.5×3.2×2.3 is an L×T surface and an element of L×W×T=3.2×2.5×1.6 is a W×T surface, and width of connected elements may be adjusted to connect with a connecting electrode 15. By doing so, even if the shapes are different, one stack structure can be obtained. Note that, in addition to the stack structure, it is also possible to connect single elements in parallel according to application.

Example 3

Figure 8:
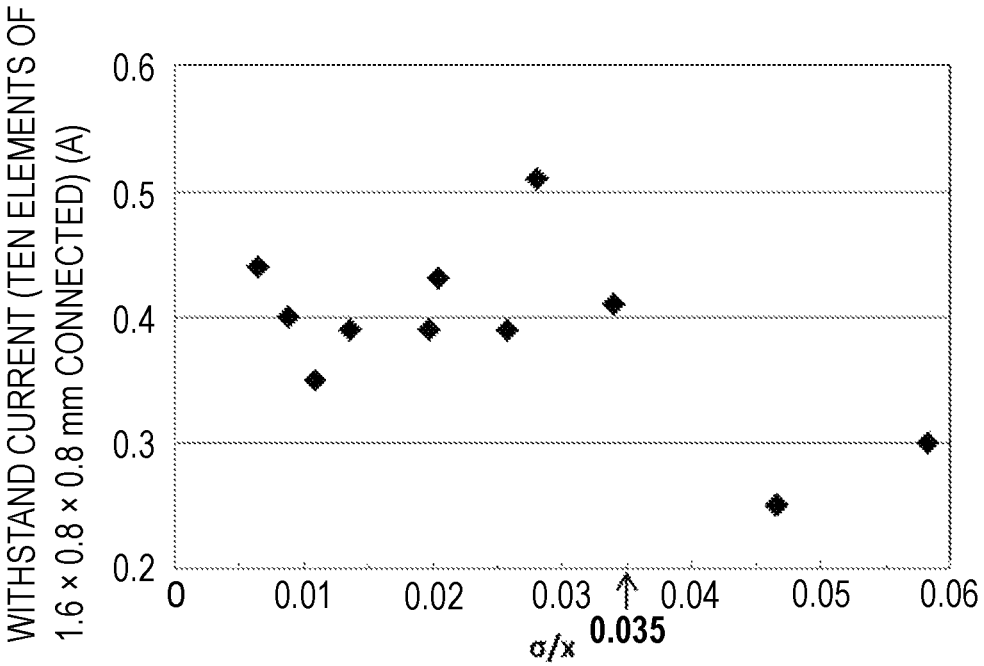
FIG. 8 is a graph showing a relationship between a coefficient of variation σ/x of $V_{1\ mA}$ and withstand current of ten varistor elements of 1.6×0.8×0.8 mm constituting connected elements in Example 3 of the present disclosure.
Figure 9:
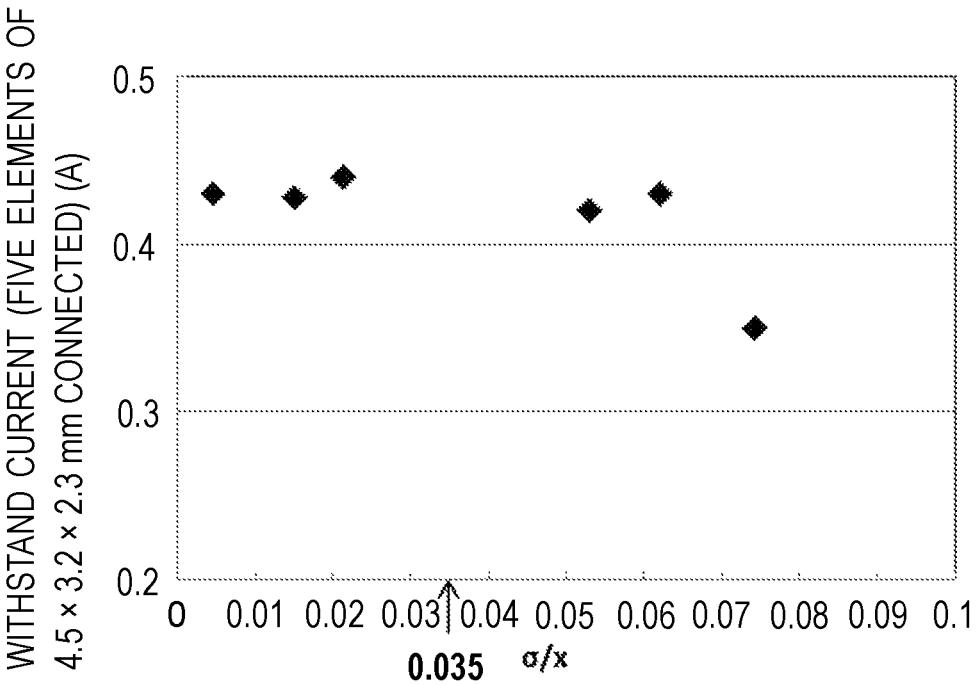
FIG. 9 is a graph showing a relationship between a coefficient of variation σ/x of $V_{1\ mA}$ and withstand current of five varistor elements of 4.5×3.2×2.3 mm constituting connected elements in Example 3 of the present disclosure.

A range of characteristics of each element when connected will be described. For characteristic distribution of the elements at the time of connection, a coefficient of variation σ/x, which is a ratio of a standard deviation σ of $V_{1\ mA}$ of the elements to be connected and an average value x of $V_{1\ mA}$, was used. For an element of 1.6×0.8×0.8 mm, ten elements were selected such that they are in a range of σ/x=0.006 to 0.058 of $V_{1\ mA}$. When the elements were connected, the coefficient of variation σ/x of $V_{1\ mA}$ was calculated, and withstand current at the time of connection was evaluated. Results of evaluation are shown in FIG. 8. It can be seen that the withstand current is reduced by 40% when σ/x>0.035. On the other hand, when σ/x≤0.035, there is almost no change in the withstand current. Further, FIG. 9 shows results when five elements of 4.5×3.2×2.3 mm were connected (σ/x=0.005 to 0.075). Again, with σ/x>0.07, a decrease in withstand current of about 30% was observed. Even with elements of other sizes, improvement in withstand current due to improvement of $V_{1\ mA}$ is saturated, and similar results are obtained. It can be seen that if distribution of varistor voltage is less than or equal to 0.035, there is no influence on withstand characteristic.

A varistor assembly of the present disclosure is useful because it can achieve good surge breakdown voltage while suppressing capacitance.

The invention claimed is:

1. A varistor assembly comprising a plurality of varistor elements connected in parallel, wherein each of the plurality of varistor elements includes a sintered body and a pair of external electrodes, the sintered body is obtained by sintering a laminate, the laminate including a plurality of varistor layers and a plurality of internal electrodes alternately laminated, the sintered body has a pair of end faces located in a direction along surfaces that the varistor layers and the internal electrodes are in contact with each other, the pair of external electrodes is provided on the pair of end faces, the plurality of varistor elements includes a plurality of first group varistor elements and one or more second group varistor elements, each of the plurality of first group varistor elements satisfies $S1/V1 \geq 1.9\ mm^{-1}$, where S1 is a surface area of the sintered body and V1 is a volume of the sintered body, $2 \leq n1 \leq 200$ is satisfied, where n1 is a number of the plurality of first group varistor elements, each of the one or more second group varistor elements satisfies $S2/V2 < 1.9\ mm^{-1}$, where S2 is a surface area of the sintered body and V2 is a volume of the sintered body, and $1 \leq n2 \leq 5$ is satisfied, where n2 is a number of the one or more second group varistor elements.

2. The varistor assembly according to claim 1, wherein n1 is $5 \leq n1 \leq 200$ is satisfied.

3. The varistor assembly according to claim 1, wherein, for varistor elements having an identical size among the plurality of first group varistor elements, a coefficient of variation of voltage when 1 mA is applied is less than or equal to 0.035.

4. A varistor assembly comprising a plurality of varistor elements connected in parallel by connecting electrode, wherein:

each of the plurality of varistor elements includes:

a sintered body having a pair of end faces;

a pair of internal electrodes disposed in the sintered body; and a pair of external electrodes, each of the pair of external electrodes disposed on each of the pair of end faces and electrically connected to each of the pair of internal electrodes, the plurality of varistor elements include a plurality of first group varistor elements and one or more second group varistor elements, each of the plurality of first group varistor elements satisfies $S1/V1 < 1.9\ mm^{-1}$, where S1 is a surface area of the sintered body and V1 is a volume of the sintered body, $2 \leq n1 \leq 200$ is satisfied, where n1 is a number of the plurality of first group varistor elements, each of the one or more second group varistor elements satisfies $S2/V2 < 1.9\ mm^{-1}$, where S2 is a surface area of the sintered body and V2 is a volume of the sintered body, and $1 \leq n2 \leq 5$ is satisfied, where n2 is a number of the one or more second group varistor elements.

5. The varistor assembly according to claim 4, wherein $5 \leq n1 \leq 200$ is satisfied.

6. The varistor assembly according to claim 4, wherein, for varistor elements having an identical size among the plurality of first group varistor elements, a coefficient of variation of voltage when 1 mA is applied is less than or equal to 0.035.

* * * * *